US007141931B2

(12) United States Patent
Park et al.

(10) Patent No.: US 7,141,931 B2
(45) Date of Patent: Nov. 28, 2006

(54) FLAT FLUORESCENT LAMP AND BACKLIGHT UNIT USING THE SAME

(76) Inventors: Deuk-il Park, 410-903, Cheongmyeong Jugong Apt., Yeongtong-dong, Paldal-gu, Suwon-si, Gyeonggi-do (KR); Choong-Yop Rhew, 601-1502, Shinnamushil Pungrim Apt., Yeongtong-dong, Paldal-gu, Suwon-si, Gyeonggi-do (KR); Ok-Bin Sur, 106-512, Gasu Jugong Apt., 113, Gasu-dong, Osan-si, Gyeonggi-do (KR)

( * ) Notice: Subject to any disclaimer, the term of this patent is extended or adjusted under 35 U.S.C. 154(b) by 155 days.

(21) Appl. No.: 10/767,066

(22) Filed: Jan. 28, 2004

(65) Prior Publication Data

US 2005/0116607 A1 Jun. 2, 2005

(30) Foreign Application Priority Data

Nov. 29, 2003 (KR) ..... 10-2003-0085914
Nov. 29, 2003 (KR) ..... 10-2003-0085915

(51) Int. Cl.
*H01J 65/00* (2006.01)

(52) U.S. Cl. ..... 313/607; 313/234; 313/484; 313/485; 313/594

(58) Field of Classification Search ..... 313/491, 313/607, 594, 609, 484, 485, 610, 113, 581, 313/582, 496, 234
See application file for complete search history.

(56) References Cited

U.S. PATENT DOCUMENTS 5,509,841 A * 4/1996 Winsor ..... 445/26
5,903,096 A 5/1999 Winsor
6,674,250 B1 * 1/2004 Cho et al. ..... 315/291
2002/0117959 A1 * 8/2002 Winsor ..... 313/484
2003/0034731 A1 * 2/2003 Masahiro et al. ..... 313/567

FOREIGN PATENT DOCUMENTS

| | | |
|---|---|---|
| JP | 60-216435 | 10/1985 |
| JP | 09-092208 | 4/1997 |
| KR | 1019990012391 | 5/1999 |
| KR | 2001-0079377 | 8/2001 |
| KR | 1020010009474 | 10/2002 |

(Continued)

*Primary Examiner*—Karabi Guharay
*Assistant Examiner*—Anthony Canning
(74) *Attorney, Agent, or Firm*—Schmeiser, Olsen & Watts LLP

(57) ABSTRACT

Disclosed is a flat fluorescent lamp, including a back substrate, a front substrate made of a transparent material and mounted on the back substrate through a sealing member disposed therebetween, a plurality of partitions disposed between the back and front substrates to define a discharge channel therebetween, a fluorescent material layer coated along a surface of the discharge channel defined by the partitions, a plurality of electrodes disposed to both the back substrate and the front substrate to cause a dielectric barrier discharge, and a reflective layer to cover the entire back substrate and upper portions of the electrodes disposed to the back substrate. In addition, a backlight unit is provided, including the above flat fluorescent lamp, a light diffusion part spaced from a top of the front substrate of the flat fluorescent lamp to diffuse light irradiated from the flat fluorescent lamp, an insulating layer disposed under the reflective layer of the flat fluorescent lamp through a first adhesive layer, and a base member disposed under the insulating layer through a second adhesive layer. Such a backlight unit is advantageous in improvement of uniform characteristics of luminance and supplement of durability of the lamp upon combination of the lamp and the base member.

9 Claims, 14 Drawing Sheets

FOREIGN PATENT DOCUMENTS

| | | |
|---|---|---|
| KR | 1020030050831 | 6/2003 |
| KR | 1020030058915 | 11/2003 |
| KR | 1020030085914 | 11/2003 |

* cited by examiner

FLAT FLUORESCENT LAMP AND BACKLIGHT UNIT USING THE SAME

BACKGROUND OF THE INVENTION

1. Field of the Invention

The present invention relates, in general, to flat fluorescent lamps and backlight units using the same, and more specifically, to a flat fluorescent lamp having an electrode structure to cause a dielectric barrier discharge, and a backlight unit using the same.

2. Description of the Related Art

In general, a flat display device is classified into a light-emitting type and a light-receiving type, in which the light-emitting type display device includes a cathode ray tube, an electron light-emitting device, a plasma display panel, etc., and the light-receiving type display device is exemplified by a liquid crystal display.

However, the liquid crystal display per se has no a light-emitting structure, and cannot display an image unless light is externally irradiated. Thus, an additional light source, for example, a backlight unit, is mounted to display the image.

Such a backlight unit acts to diffuse light irradiated from a cold cathode fluorescent lamp (CCFL) through a light plate and a diffusion plate, or may diffuse light by exciting a fluorescent material through ultraviolet rays by use of a flat fluorescent lamp.

With reference to FIG. 1, there is shown a conventional flat fluorescent lamp. Such a fluorescent lamp 10 includes a back substrate 11, and a front substrate 12 mounted at predetermined intervals to the back substrate 11 through a sealing member 13, whereby a discharge channel is formed between the back and front substrates 11 and 12. In addition, a fluorescent material layer 16 is formed to a bottom surface of the front substrate 12, and discharge electrodes 14 are formed in a predetermined pattern to a top surface of the back substrate 11 corresponding to the fluorescent material layer 16. Further, a dielectric layer 15 is formed on the back substrate 11 to embed the discharge electrodes 14 therein. In the discharge channel, a discharge gas, such as xenon (Xe), neon (Ne), etc., is filled.

The conventional flat fluorescent lamp 10 is structured to cause a surface light emission by exciting the fluorescent material layer 16 through ultraviolet rays generated by a surface discharge of the electrodes, according to the application of a power to the discharge electrodes 14.

However, since the conventional flat fluorescent lamp mainly employs an inert gas, such as xenon (Xe), neon (Ne) or Xe—Ne, as a discharge gas, it has an alternating voltage as high as 2 kV that is applied to the discharge electrodes 14, and a light efficiency as low as 30 lm/W or less. Hence, with the intention of obtaining large quantities of light, the discharge channel of the above lamp 10 should be enlarged and an operation power should increase, resulting in increased power consumption. In addition, since the used discharge gas is inert, the fluorescent material layer 16 is excited by ultraviolet rays of 147 or 173 μm. Consequently, the above fluorescent lamp is disadvantageous in terms of using an expensive fluorescent material, instead of a mass-produced fluorescent material for ultraviolet rays of 254 μm.

On the other hand, a typical flat fluorescent lamp using mercury has a long serpentine type discharge channel, in which electrodes are disposed to a staring point and an ending point of the discharge channel. Thereby, relatively large electrical current flows in the discharge channel, and mercury can be easily evaporated, thus realizing the high efficiency of a mercury discharge.

However, as the discharge channel becomes longer, a voltage required to initiate the discharge increases. In cases of increasing the discharge voltage, the lamp may suffer from unstability, current leakage and electronic wave problems. Further, a flat fluorescent lamp is large-sized in recent years, due to the use of a large liquid crystal display, whereby there is necessary a drastically lengthened serpentine channel. Hence, it is impossible to realize a circuit required for such a discharge voltage.

To solve the problems, Korean Patent Laid-open Publication No. 2001-0079377 discloses a flat fluorescent lamp and a manufacturing method thereof.

The disclosed manufacturing method of the flat fluorescent lamp includes heating a flat glass plate to predetermined molding temperatures, molding the heated flat glass plate by use of a mold processed to have a plurality of discharge channels separated by partitions and communicated with discharge paths, to prepare a molded flat glass plate having discharge channels, removing the molded glass plate from the mold, slowly cooling the molded glass plate, coating a fluorescent material to the insides of the discharge channels of the molded glass plate, followed by a burning process, attaching the glass plate to a front cover through a seal paste, removing air from the insides of the discharge channels of the glass plate, introducing a discharge gas into the discharge channels, sealing exhaust ports of the discharge channels, and mounting electrodes to apply high frequency power to the discharge channels.

As for the above method, the electrodes used for the application of the high frequency power are inner electrodes mounted to the insides of the discharge channels or are disposed along the entire longitudinal lengths of both lateral surfaces of the discharge channels.

Although such a flat fluorescent lamp is difficult to fabricate because of molding the heated glass plate to define the discharge channels, it has no problems related to the application of the high voltage to the electrodes. However, crosstalk between the discharge channels may occur, due to a strong discharge in a specific discharge channel among the discharge channels or severely shaking discharge plasma.

This is because discharge charges are easily moved through the inner surfaces of apertures of the electrodes and thus the discharge charges crowd in the discharge channel which relatively easily causes the discharge.

Japanese Patent Laid-open Publication No. Sho. 60-216435 discloses a flat fluorescent lamp, in which partitions are alternately disposed in a zigzag shape in a chamber having a closed space to define a serpentine discharge channel. Further, electrodes are disposed to both ends of the discharge channel, and fluorescent material layers are formed on the top and bottom of the discharge channels. However, such a flat fluorescent lamp suffers from drawbacks, such as non-uniform luminance, due to weak light emission at an edge of the discharge channel, requirement of a high discharge voltage, and easy deterioration of the electrodes.

In Japanese Patent Laid-open Publication No. Hei. 09-092208 and U.S. Pat. Nos. 5,903,096 and 5,509,841, there is disclosed a planar light source having a serpentine channel defined by partitions. In particular, U.S. Pat. No. 5,509,841 discloses a metallic body having a serpentine channel.

SUMMARY OF THE INVENTION

Accordingly, an object of the present invention is to alleviate the problems encountered in the related art and to provide a flat fluorescent lamp, which is advantageous in terms of low voltage required to initiate a discharge, low power consumption, improved light-emitting efficiency, and uniform luminance.

Another object of the present invention is to provide a backlight unit using the flat fluorescent lamp, having advantages, such as a stable discharge due to the use of mercury as a discharge gas and employing a low voltage in the state of each discharge channel being not isolated, a maximized light-emitting efficiency of the lamp, and supplement of durability of the lamp.

To achieve the above objects, according to a first embodiment of the present invention, there is provided a flat fluorescent lamp, comprising a back substrate, a front substrate made of a transparent material and mounted on the back substrate through a sealing member disposed therebetween to be spaced from the back substrate by a predetermined interval, a plurality of partitions disposed between the back substrate and the front substrate to define a discharge channel therebetween, a fluorescent material layer coated along a surface of the discharge channel defined by the partitions, a plurality of electrodes disposed to both the back substrate and the front substrate to cause a dielectric barrier discharge, and a reflective layer to cover the entire back substrate and upper portions of the electrodes disposed to the back substrate.

Further, a backlight unit comprises the flat fluorescent lamp mentioned above, a light diffusion part spaced from a top of the front substrate of the flat fluorescent lamp to diffuse light irradiated from the flat fluorescent lamp, an insulating layer disposed under the reflective layer of the flat fluorescent lamp through a first adhesive layer, and a base member disposed under the insulating layer through a second adhesive layer.

According to a second embodiment of the present invention, there is provided a flat fluorescent lamp, comprising a back substrate, a front substrate made of a transparent material and mounted on the back substrate through a sealing member disposed therebetween to be spaced from the back substrate by a predetermined interval, a plurality of partitions disposed between the back and front substrates and having odd number of partitions in close contact with the sealing member disposed at one side edge of the back substrate and even number of partitions in close contact with the sealing member disposed at the other side edge of the back substrate to define a discharge channel therebetween, a fluorescent material layer coated along a surface of the discharge channel defined by the partitions, and a plurality of electrodes disposed to both the back substrate and the front substrate to cause a dielectric barrier discharge.

Furthermore, a backlight unit comprises the flat fluorescent lamp mentioned above, a light diffusion layer spaced from a top of the front substrate of the flat fluorescent lamp to diffuse light irradiated from the flat fluorescent lamp, an insulating reflective layer disposed under the electrodes of the back substrate of the flat fluorescent lamp through a first adhesive layer, and a base member disposed under the insulating reflective layer through a second adhesive layer.

The backlight unit using the flat fluorescent lamp of the present invention is advantageous in terms of improved luminance by the formation of the reflective layer, and low voltage required to initiate a discharge by widening widths of the electrodes due to the formation of apertures of the electrodes. In addition, a plasma discharge region is adjusted, thereby increasing uniform luminance characteristics. Also, durability of the flat fluorescent lamp can be supplemented upon combination of the base member and the flat fluorescent lamp.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Hereinafter, a detailed description will be given of the present invention with reference to the appended drawings.

Figure 1:
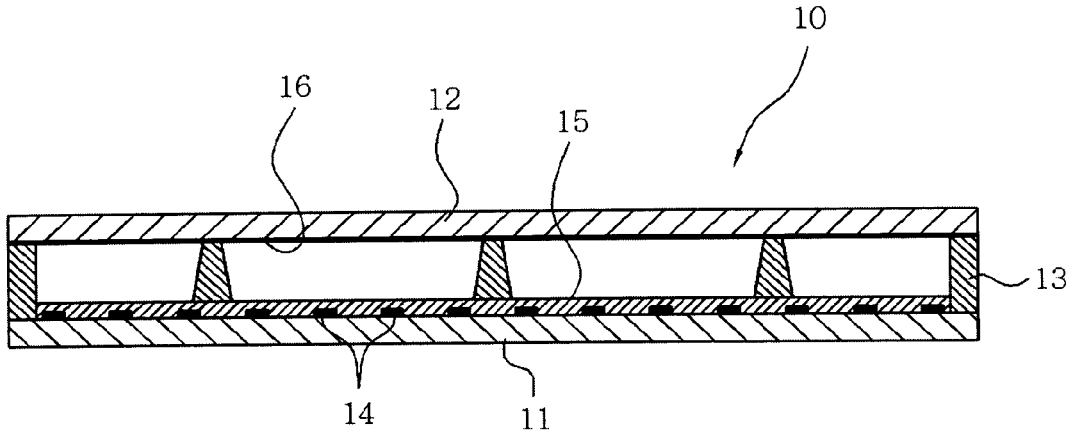
FIG. 1 is a cross-sectional view of a conventional flat fluorescent lamp.
Figure 2:
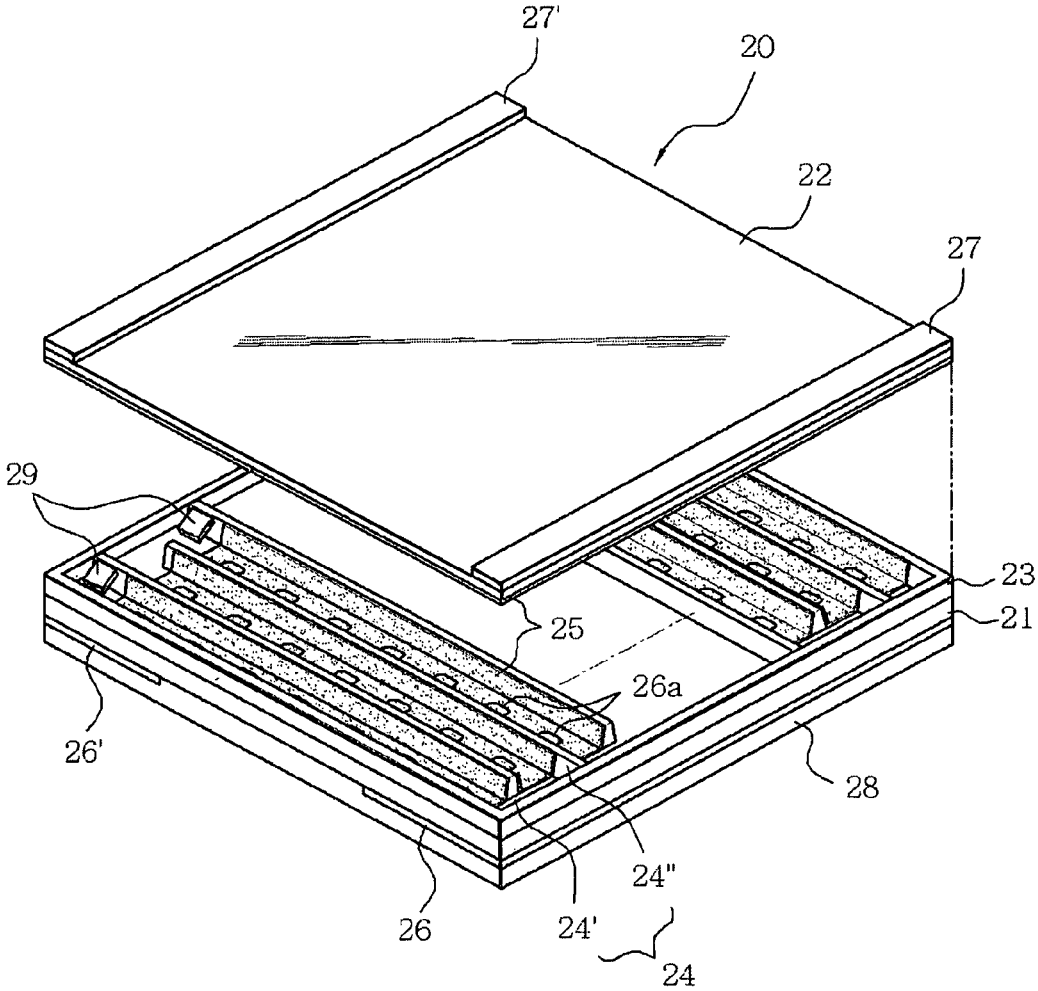
FIG. 2 is an exploded perspective view of a flat fluorescent lamp, according to a first embodiment of the present invention.
Figure 3:
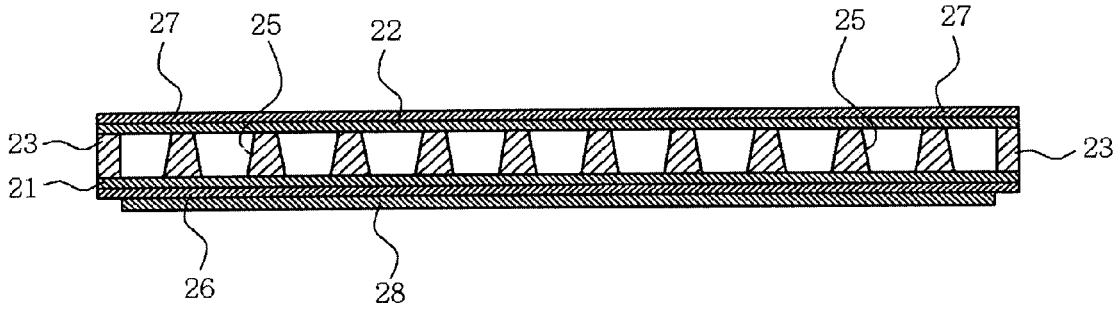
FIG. 3 is a cross-sectional view taken along the line A—A of FIG. 2.

FIG. 2 is an exploded perspective view of a flat fluorescent lamp, according to a first embodiment of the present invention, and FIG. 3 is a cross-sectional view taken along the line A—A of FIG. 2.

As shown in FIGS. 2 and 3, a flat fluorescent lamp 20 includes a back substrate 21, a front substrate 22, partitions 24, a fluorescent material layer 25, electrodes 26, 26', 27 and 27', and a reflective layer 28.

Specifically, the flat fluorescent lamp 20 has the back substrate 21, and the front substrate 22 placed onto the back substrate 21 through a sealing member 23. Also, a plurality of the partitions 24, which define a discharge channel of a zigzag shape between the back substrate 21 and the front substrate 22, in which the channel zigzags in a side to side direction generally transverse to an end to end direction of the flat flourescent lamp 20 and the substrates 21 and 22, as shown in FIG. 2. The partitions 24 are in close contact with the front substrate 22 and are alternately disposed to be spaced from each other by a predetermined interval. Further, two pairs of the electrodes 26, 26' and 27, 27' are disposed along each side to both ends of the back substrate 21 and both ends of the front substrate 22, respectively. The fluorescent material layer 25 is coated along the discharge channel defined by the partitions 24, and the reflective layer 28 is formed to cover the back substrate 21. As such, the front substrate 22 is preferably made of a transparent material capable of allowing light to transmit therethrough.

As shown in FIG. 2, the partitions 24 are disposed between the back substrate 21 and the front substrate 22 to be alternately spaced from both side edges of the back and front substrates 21 and 22, thereby defining the discharge channel, which is then coated with the fluorescent material layer 25. As for the partitions 24, odd number of partitions 24' are in close contact with the sealing member 23 disposed at one side edge of the back substrate 21, and even number of partitions 24" are in close contact with the sealing member 23 disposed at the other side edge of the back substrate 21. Thereby, the partitions 24 are alternately disposed in a continuous zigzag shape to define the discharge channel between the back substrate 21 and the front substrate 22. That is, it is preferable that one side end of the partitions 24 are alternately spaced at a predetermined interval from the corresponding side edges of the back and front substrates 21 and 22. Top surfaces of the partitions 24 each have widths of 2 mm or less to minimize a non-transmitting region. Pitches of the partitions 24 or pitch of the discharge channel defined by the partitions 24 are preferably in the range of 5 to 15 mm.

Figure 4A:
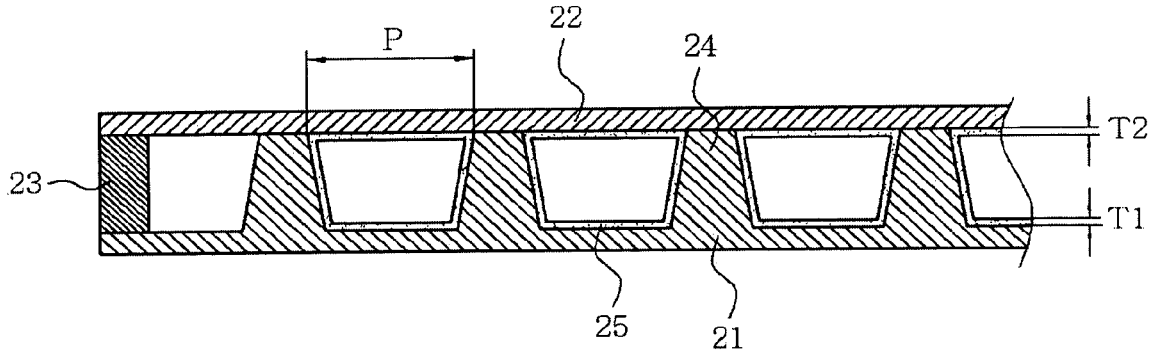
FIGS. 4*a* to 4*c* are cross-sectional views of modifications of partitions included in the flat fluorescent lamp of FIG. 2.
Figure 4B:
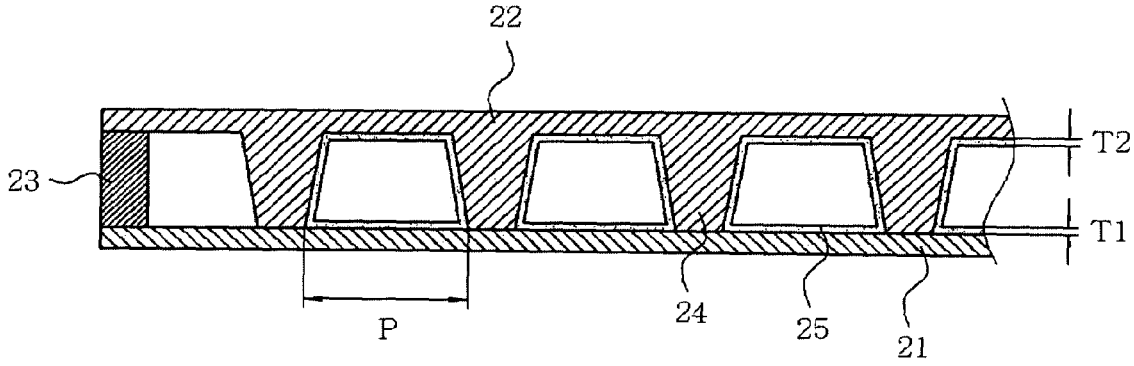
Figure 4C:
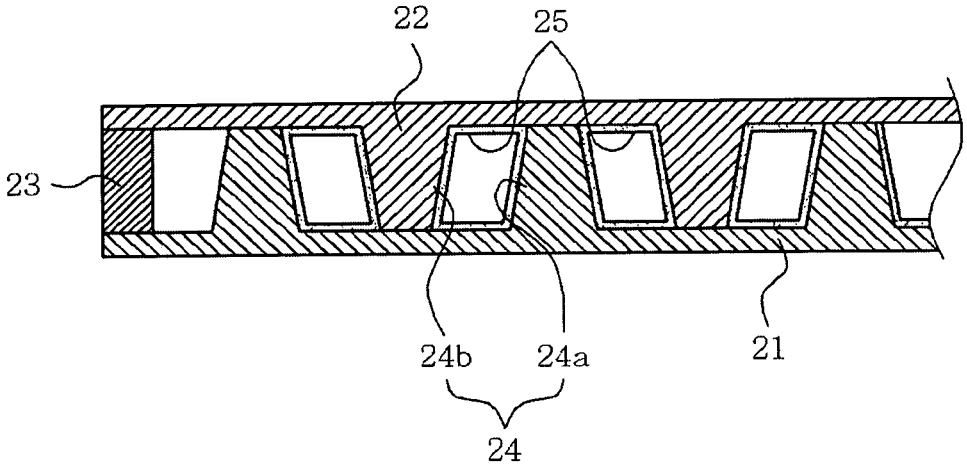

In addition, modifications of the partitions 24 are shown in FIGS. 4*a* to 4*c*, in which the partitions 24 vary in shapes thereof, depending on the back substrate 21 and the front substrate 22. For instance, the partitions 24 may be integratedly formed with the back substrate 21 as in FIG. 4*a*, or with the front substrate 22 as in FIG. 4*b*, by subjecting the back substrate 21 or the front substrate 22 to sand blasting or laser etching or softening and then molding under pressure or reduced pressure.

Further, as seen in FIG. 4*c*, the partitions 24 include first partitions 24*a* integratedly formed with the back substrate 21 and second partitions 24*b* integratedly formed with the front substrate 22. As such, it is preferred that the first partitions 24*a* and the second partitions 24*b* are manufactured to be alternately disposed.

According to FIG. 2, the fluorescent material layer 25 is coated along the surface of the discharge channel defined by the back substrate 21, the front substrate 22, and the partitions 24. Also, the fluorescent material layer 25, as seen in FIGS. 4*a* to 4*c*, is formed so that a thickness (T2) of the fluorescent material layer coated to the front substrate 22 is less than a thickness (T1) of the fluorescent material layer coated on the back substrate 21 and the partitions 24, in consideration of transmission of the excited light through the fluorescent material layer 25 coated to the front substrate 22. Preferably, the fluorescent material layer 25, which is coated on the back substrate 21, the front substrate 22 and the partitions 24, is thinly coated at 25 μm or less.

Into the discharge channel defined by the partitions 24, a discharge gas, including a rare gas, such as mercury (Hg), argon (Ar), neon (Ne), helium (He), krypton (Kr) or xenon (Xe) used alone, or a mixture gas, such as Ne—Ar, He—Ar and Ne—Xe, is introduced. As a main exciting source of a fluorescent material constituting the fluorescent material layer 25, use is taken of ultraviolet rays of mercury or xenon.

Further, metal pieces 29 impregnated with mercury are disposed in the discharge channel defined by the partitions 24 such that the metal pieces 29 are arranged on one side edge of the back substrate 21, so as to feed mercury to the discharge gas introduced into the discharge channel.

The two pairs of electrodes 26, 26' and 27, 27' are disposed to both ends of each outer surface of the back substrate 21 and the front substrate 22, corresponding to turning points of the discharge channel defined by the partitions for a plasma discharge.

The lower pair of electrodes 26 and 26' are symmetrically formed in a strip shape to both ends of an outer surface of the back substrate 21, as shown in FIG. 2. The upper pair of electrodes 27 and 27' are also formed in a strip shape to the front substrate 22. Further, the electrodes 26, 26' and 27, 27' each have a relatively greater width so as to decrease distances between the electrodes disposed to be mutually opposite, compared to conventional electrodes.

Figure 5A:
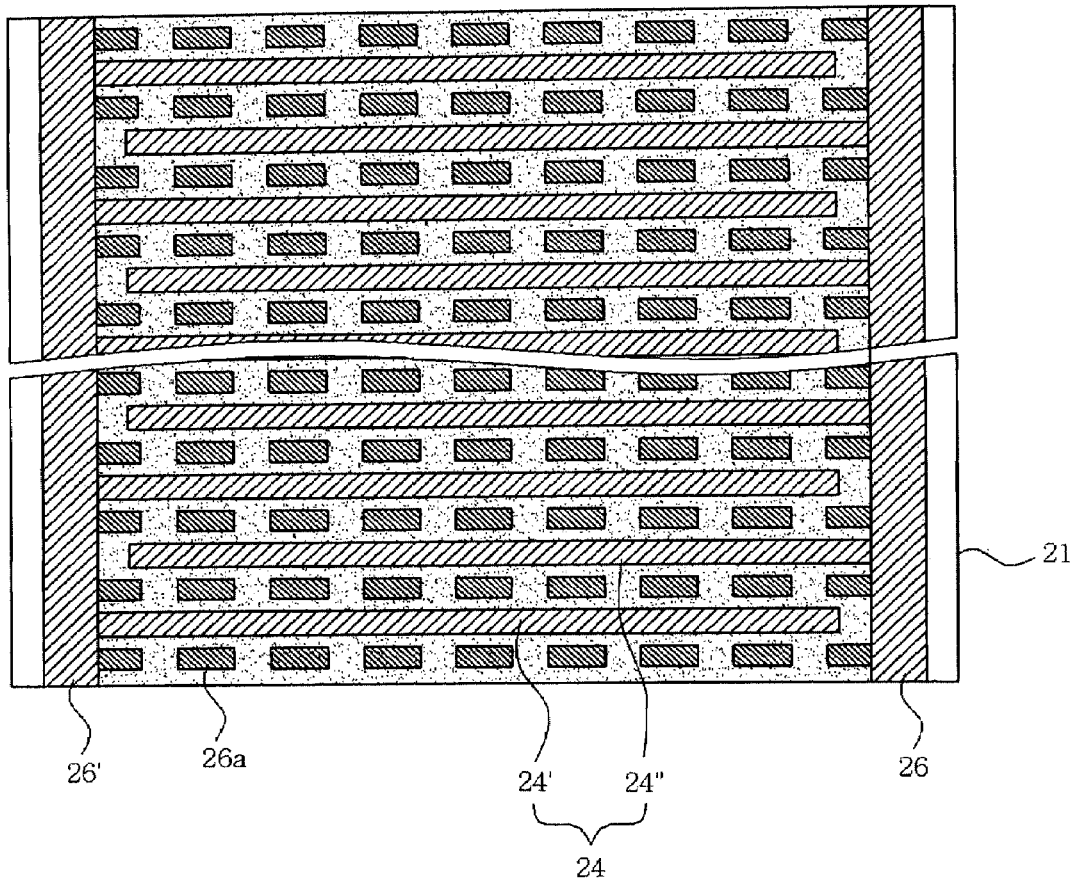
FIGS. 5*a* to 5*e* are top views of modifications of electrodes included in the flat fluorescent lamp of FIG. 2.
Figure 5B:
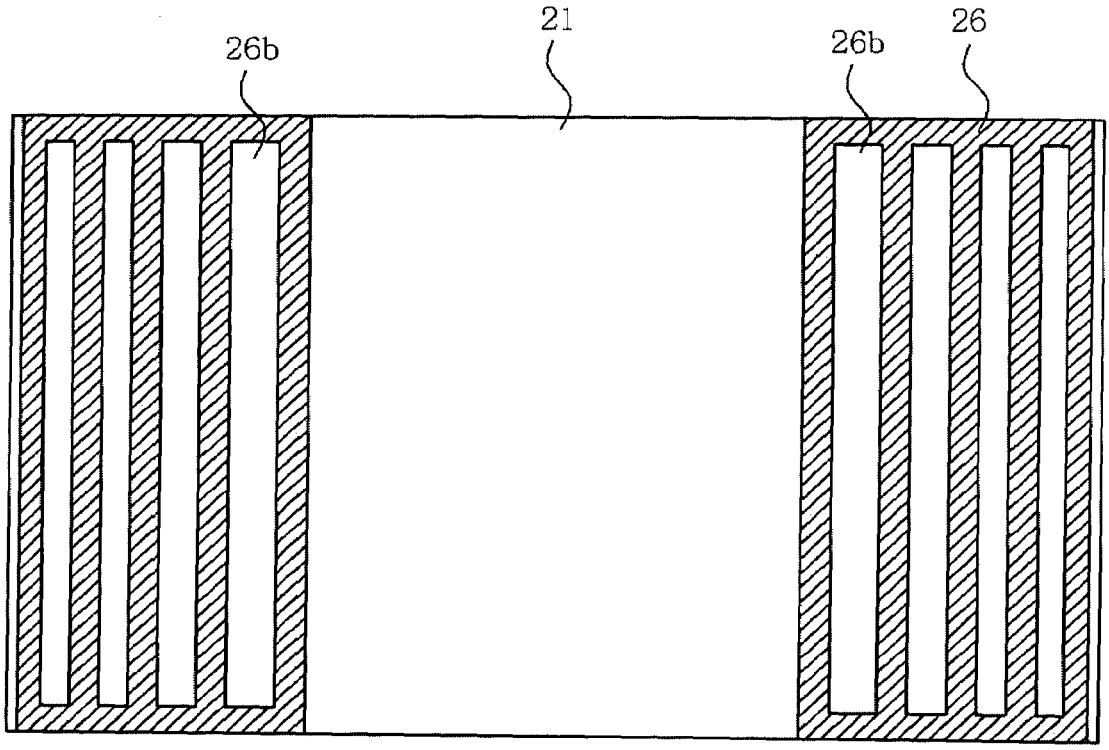
Figure 5C:
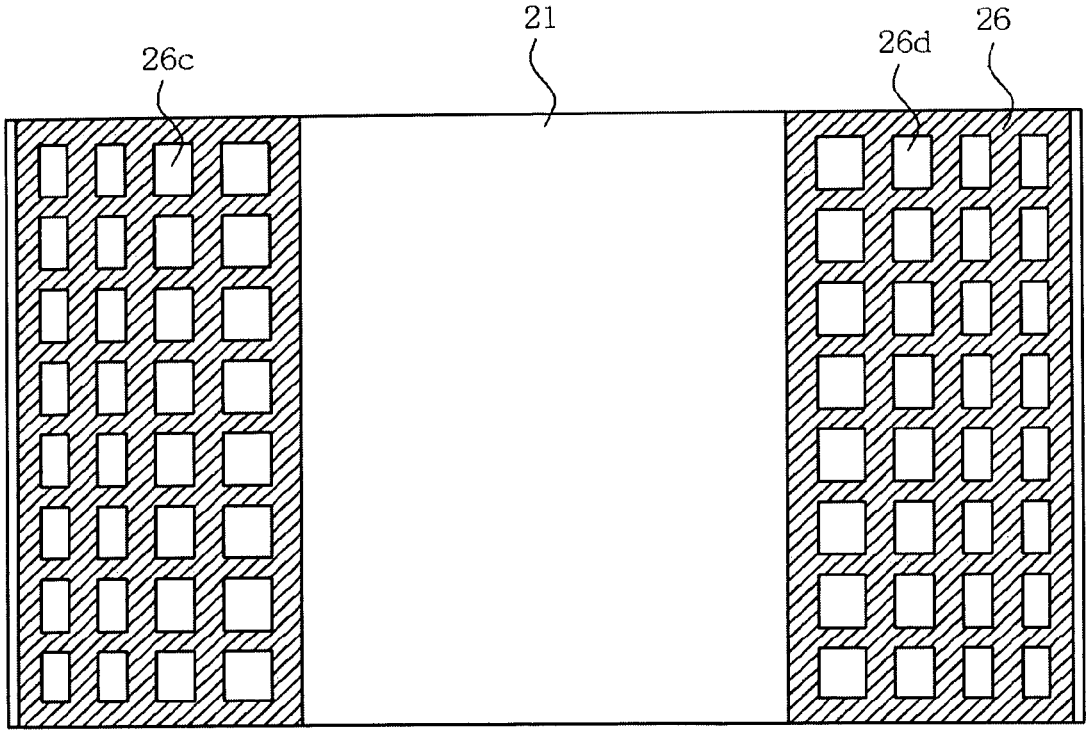
Figure 5D:
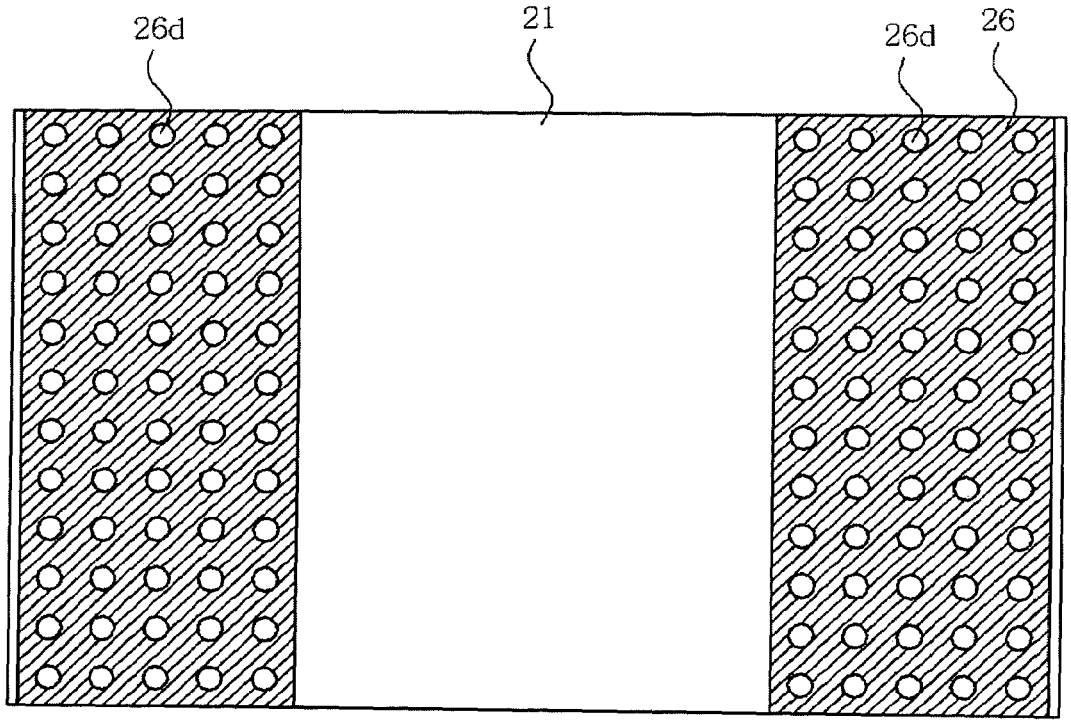
Figure 5E:
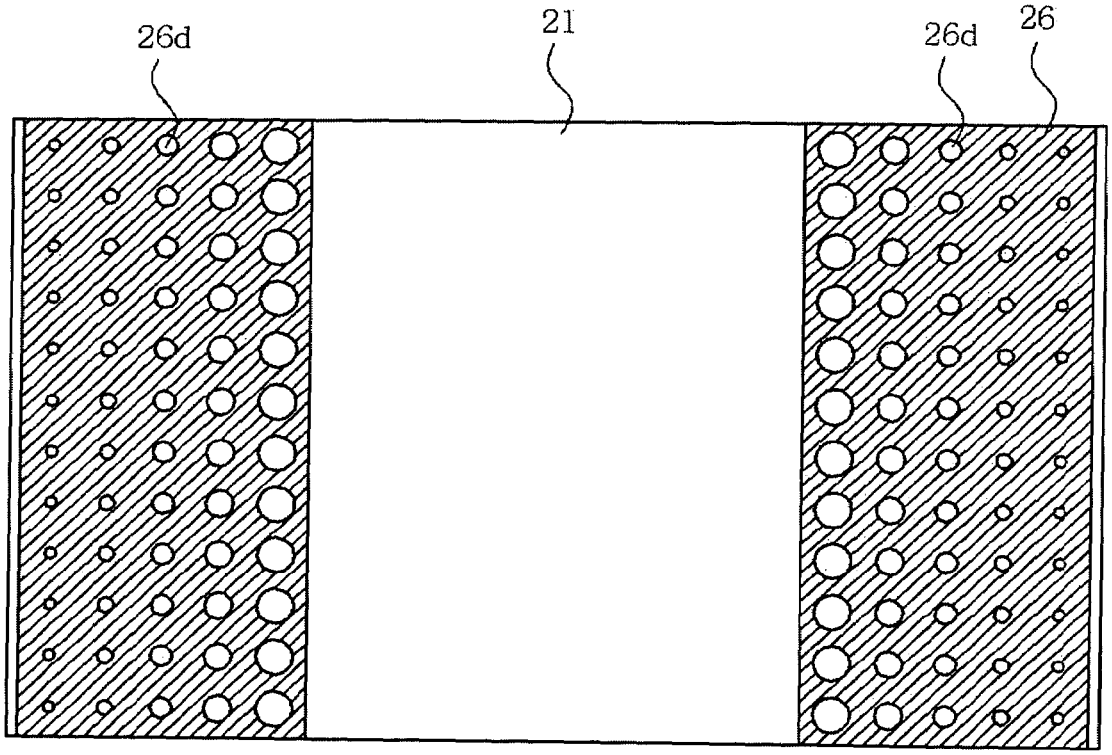

As shown in FIGS. 2 and 5*a*, a plurality of floating electrodes 26*a* may be disposed between the electrodes 26 and 26'. In this case, additional floating electrodes 26*a* are intermittently placed in the discharge channel, and thus a voltage is induced by a power applied to the electrodes 26 and 26', thus causing the discharge. Accordingly, a more stable discharge can be achieved by initiating the discharge at a relatively low voltage while the electrodes 26 and 26' remain in the positions.

As shown in FIGS. 5*b* to 5*e*, the mutually opposite two electrodes 26 and 26' may be formed to have stripe, square- and circle-shaped apertures 26*b*, 26*c* and 26*d*. The apertures 26*b*, 26*c* and 26*d* of the electrodes 26 and 26' disposed to both ends of the back substrate 21 increase in sizes toward the inner sides of the electrodes 26 and 26' facing each other. That is, the sizes of the apertures 26*b*, 26*c* and 26*d* of the electrodes 26 and 26' gradually decrease toward the outer sides of the electrodes 26 and 26' facing each other. Thus, areas per unit surface areas of the mutually opposite electrodes 26 and 26' of the back substrate 21 gradually decrease toward the outer sides. However, the shapes of the apertures 26*b*, 26*c* and 27*d* of the electrodes 26 and 26' are not limited to the above examples.

As shown in FIGS. 2 and 3, the reflective layer 28 is formed to cover the entire back substrate 21 including the electrodes 26 and 26' of the back substrate 21. The reflective layer 28 is made of a mixture of a glass material and a white ceramic material consisting mainly of $Al_2O_3$, $TiO_2$ and $WO_3$, each of which has a high light-reflecting efficiency. Further, the reflective layer 28 is coated at a thickness not less than 20 μm to have a sufficient reflective efficiency and insulating function.

Figure 6:
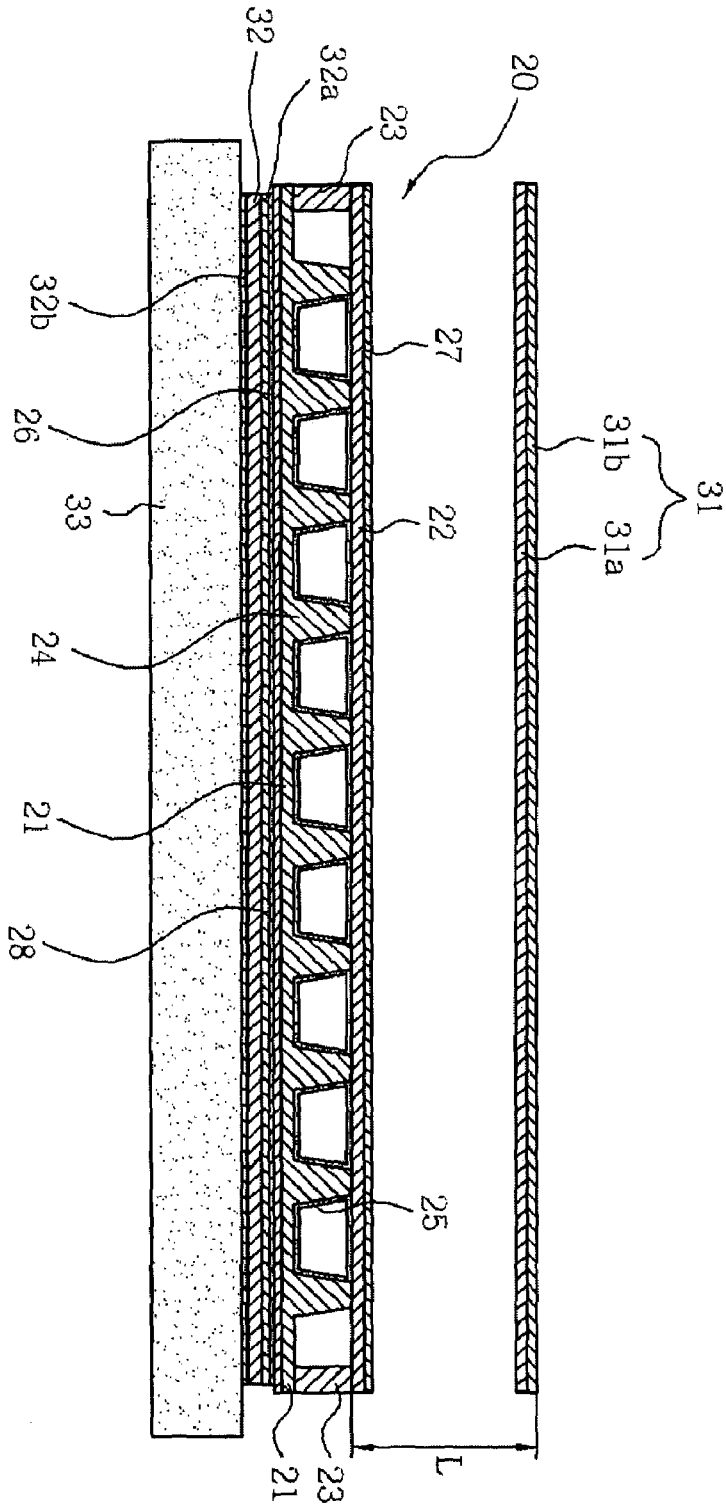
FIG. 6 is a cross-sectional view of a backlight unit comprising the flat fluorescent lamp according to the first embodiment of the present invention.

FIG. 6 is a cross-sectional view of a backlight unit comprising the flat fluorescent lamp according to the first embodiment of the present invention.

As shown in FIG. 6, the backlight unit includes the flat fluorescent lamp 20, a light diffusion part 31 to diffuse light irradiated from the flat fluorescent lamp 20, and an insulating layer 32 and a base member 33 provided on a lower surface of flat fluorescent lamp 20.

In such a case, the flat fluorescent lamp 20 has a back substrate 21, a front substrate 22, partitions 24, a fluorescent material layer 25, electrodes 26, 26', 27 and 27', and a reflective layer 28, according to the first embodiment of the present invention.

As seen in FIG. 6, the light diffusion part 31 has a first function which diffuses the light generated by a fluorescent material excited from the flat fluorescent lamp 20, and a second function allowing a non-transmitting region by the partitions 24 not to display. The light diffusion part 31 has a transparent plate 31*a* that transmits the light from the flat fluorescent lamp 20, and a diffusion plate 31*b* disposed to be in contact with the transparent plate 31*a* to diffuse the light The diffusion plate 31*b* is preferably made of an acryl plate having diffusibility.

The light diffusion part 31 is disposed so that a distance (L) between an upper surface of the flat fluorescent lamp 20 and an upper surface of the diffusion plate 31*b* is as long as ½ to 2 times of pitch (P) of the partitions 24 or pitch of the channel defined by the partitions 24.

The insulating layer 32 is attached to a lower surface of the reflective layer 28 of the flat fluorescent lamp 20 through a first adhesive layer 32*a*, to insulate a lower portion of the flat fluorescent lamp 20. The first adhesive layer 32*a* is made of a material which has heat resistance and can be firmly fixed to the flat fluorescent lamp 20 even in the state of the lamp 20 being heated by the discharge.

The base member 33 is attached to a lower surface of the insulating layer 32 through a second adhesive layer 32*b*, to prevent any bending of the flat fluorescent lamp 20 or destruction thereof by external impact The base member 33 is preferably made of a metal sheet, and includes protrusions of lattice structures or is cast, so as not to be bent.

Figure 7:
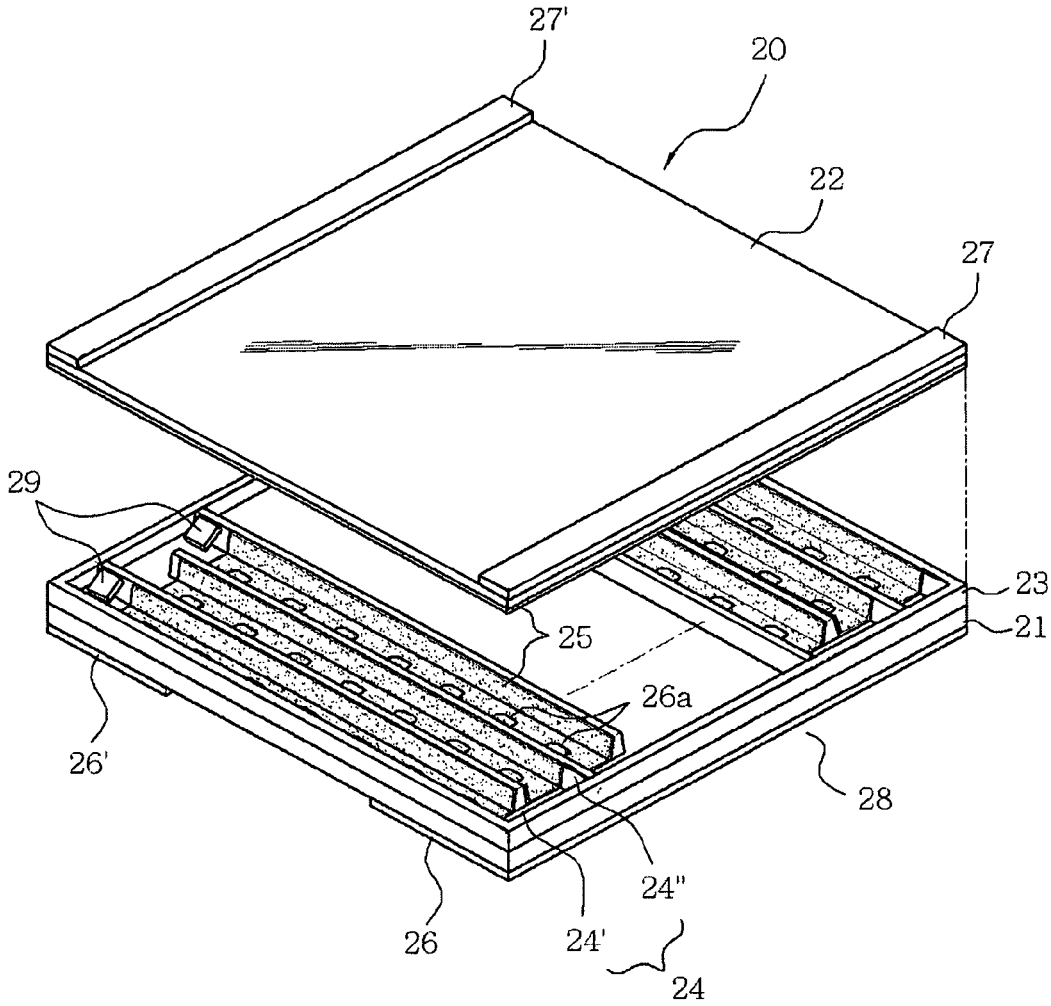
FIG. 7 is an exploded perspective view of a flat fluorescent lamp, according to a second embodiment of the present invention.

Turning now to FIG. 7, there is shown an exploded perspective view of a flat fluorescent lamp, according to a second embodiment of the present invention.

As shown in FIG. 7, the flat fluorescent lamp 20 includes a back substrate 21, a front substrate 22, partitions 24, a fluorescent material layer 25, and electrodes 26, 26', 27 and 27'. The flat fluorescent lamp 20 according to the second embodiment of the present invention has the same structure to that according to the first embodiment of the present invention, with the exception of the reflective layer 28 of the first embodiment.

That is, as for the flat fluorescent lamp 20 according to the second embodiment, the front substrate 22 is mounted to the back substrate 21 through a sealing member 23. A plurality of partitions 24, defining a discharge channel of a zigzag shape between the back substrate 21 and the front substrate 22, are in close contact with the front substrate 22 and are alternately disposed to be spaced from each other by a predetermined interval. In addition, two pairs of electrodes 26, 26' and 27, 27' are placed to both ends of the back substrate 21 and both ends of the front substrate 22. Further, a fluorescent material layer 25 is coated along the discharge channel defined by the partitions 24.

Figure 8:
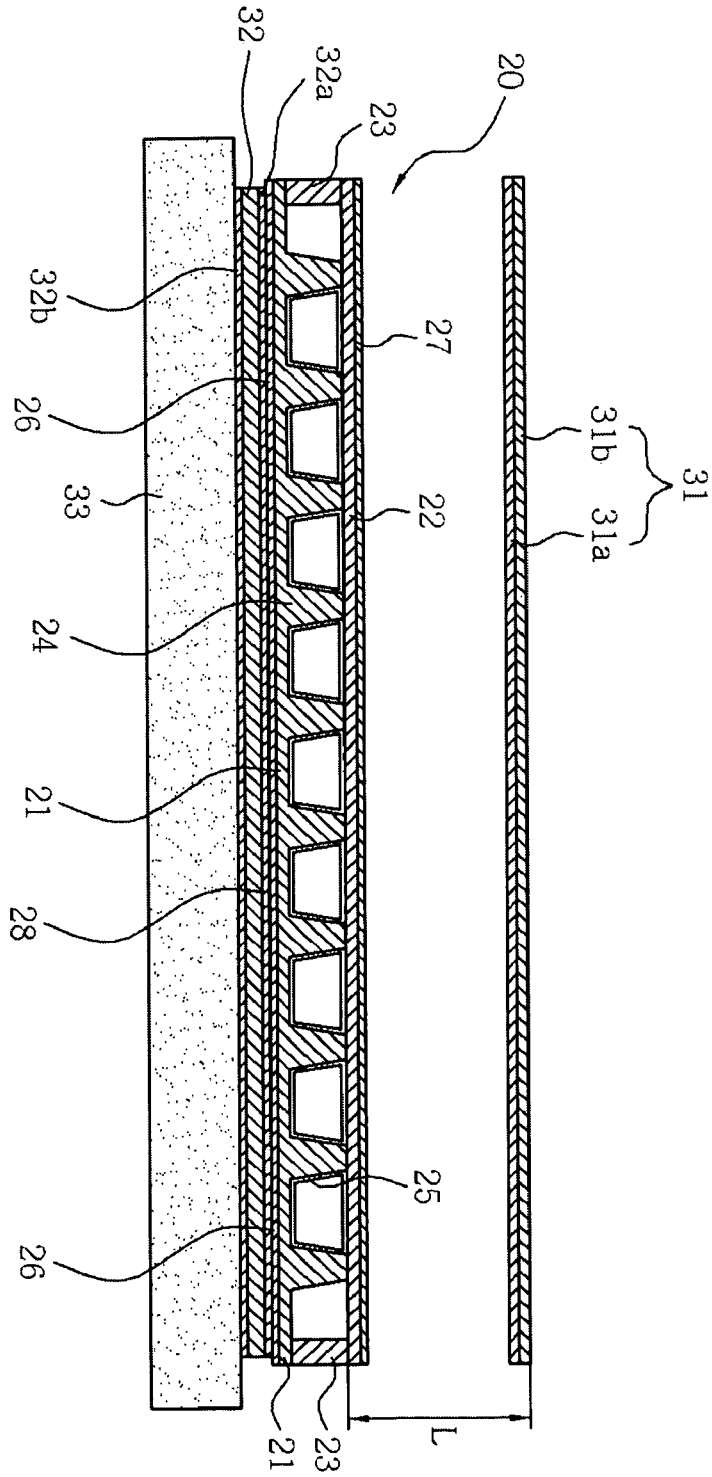
FIG. 8 is a cross-sectional view of a backlight unit comprising the flat fluorescent lamp according to the second embodiment of the present invention.

Referring to FIG. 8, there is shown a cross-sectional view of a backlight unit comprising the flat fluorescent lamp according to the second embodiment of the present invention.

As shown in FIG. 8, the backlight unit includes a flat fluorescent lamp 20, a light diffusion part 31 diffusing light illustrated from the flat fluorescent lamp 20, and an insulating reflective layer 32 and a base member 33 provided on a lower surface of the flat fluorescent lamp 20.

As such, the flat fluorescent lamp 20 has a back substrate 21, a front substrate 22, partitions 24, a fluorescent material layer 25, and electrodes 26, 26', 27 and 27', according to the second embodiment of the present invention.

As in FIG. 8, the light diffusion part 31 functions, firstly, to diffuse the light generated by the fluorescent material which is excited from the flat fluorescent lamp 20, and, secondly, to allow a non-transmitting region by the partitions 24 not to display. The light diffusion part 31 has a transparent plate 31*a* that transmits the light from the flat fluorescent lamp 20, and a diffusion plate 31*b* disposed to be in contact with the transparent plate 31*a* to diffuse the light. In such a case, the diffusion plate 31*b* is preferably made of an acryl plate having diffusibility.

The light diffusion part 31 is disposed so that a distance (L) between an upper surface of the flat fluorescent lamp 20 and an upper surface of the diffusion plate 31*b* is as long as ½ to 2 times of pitch (P) of the partitions 24 or pitch of the channel defined by the partitions 24.

The insulating reflective layer 32 is provided under the fluorescent material layer 25 of the flat fluorescent lamp 20 through a first adhesive layer 32*a*, to insulate a lower portion of the flat fluorescent lamp 20 and simultaneously reflect the light. The adhesive layer 32*a* is made of a material which has heat resistance and can be firmly fixed to the flat fluorescent lamp 20 even in the state of the lamp 20 being heated by the discharge.

The base member 33 is disposed under the insulating reflective layer 32 through a second adhesive layer 32*b*, to prevent bending of the flat fluorescent lamp 20 or destruction thereof by external impact. The base member 33 is preferably made of a metal sheet, and includes protrusions of lattice structures or is cast, so as not to be bent.

Below, effects of the flat type backlight unit of the present invention are described.

To operate the light unit, an alternating or pulse voltage is applied to the electrodes 26 and 27. Thereafter, an electric field is formed on surfaces corresponding to the electrodes 26 and 27 of the flat fluorescent lamp 20. The formed electric field can accelerate a spatial electric charge in the discharge channel, and the accelerated free electrons function to ionize the discharge gas to drastically increase the number of the spatial electric charge, thus forming plasma. Mercury is gasified and ionized by heat generated by the plasma, and receives the energy of the spatial electric charge, in the plasma state. Thereby, while an excited mercury atom is stabilized, ultraviolet rays of 254 μm occur.

Such ultraviolet rays, generated upon the discharge, function to excite a fluorescent material of the fluorescent material layer 25 coated to the discharge channel and convert the excited fluorescent material to visible light. As such, unique discharge of respective channels can be maintained only when the upper ends of the partitions 24 are in close contact with the front substrate 22. Unless the upper ends of the partitions 24 are in close contact with the substrate 22, discharge crosstalk between the channels severely occurs by the characteristics of the plasma which causes the discharge along a minimal electrical resistant space. In such a case, since an electric current is focused on only one discharge channel, it may be impossible to turn on all the lamps.

During the operation of the unit, the mercury-impregnated metal pieces 29, which are placed in the discharge channel defined by the partitions 24, act to feed mercury to constantly maintain a mercury partial pressure in the discharge channel. In particular, the electrode 26 has a relatively greater width and includes the apertures 26*b*, 26*c* and 26*d*, and thus the plasma discharge region can be formed to be relatively wider. Since the apertures 26*b*, 26*c* and 26*d* of the electrode 26 are formed to have sizes increasing gradually toward the inner sides of the electrodes, a non-uniform plasma discharge by the voltage difference due to a nearing of the electrode 26 can be fundamentally solved.

In an electrode structure having the floating electrode 26*a*, the discharge can occur even at a low voltage by narrowing a distance between the electrodes by a floating voltage.

Further, in a combination electrode structure having the apertures 26*b*, 26*c* and 26*d* and the floating electrode 26*a*, an electrode design can be easily realized. Also, a distortion phenomenon of the discharge by a surface electrical field of the electrode per se is drastically decreased, and thus non-uniform luminance can be prevented upon tuning on the lamp. According to experiments of the present inventors, since the distance between the electrodes can decrease, a voltage required to initiate the discharge reduces by 30% or more, and the shape of the electrode pattern and the apertures are modified, thus controlling a light-emitting distribution.

The electrode may be prepared by use of the white material, whereby visible light generated from the flat lamp can be reflected in a front direction, thus increasing a light efficiency by 2%. The reflective layer which covers the entire back substrate including the electrode material functions to maximize the decrease of the loss of visible light generated from the flat lamp to a back side of the lamp, thereby increasing the light efficiency of the flat fluorescent lamp. In particular, through the experiment of the present inventors, it can be found that the light efficiency is improved in the range of 6% or more, depending on the disposition of the reflective layer.

The light emitted by the flat fluorescent lamp 20 is irradiated through the transparent plate 31*a* and the diffusion plate 31*b* of the light diffusion part 31 supported to the base member 33. As such, the distance from the fluorescent lamp 20 to the diffusion plate 31*b* is as long as ½ to 2 times of the pitch of each of the partitions. Hence, spot patterns caused by the luminance of the channel relatively higher than that of the partitions can be eliminated.

As described hereinbefore, the present invention provides a flat fluorescent lamp and a backlight unit using the same. In the backlight unit, electrodes are formed to have apertures and have a greater width, thus decreasing a voltage required to initiate the discharge and controlling a plasma discharge region. Thereby, the luminance can be uniformly increased. Further, the flat fluorescent lamp is combined with the base member through the reflective layer/adhesive layer/insulating layer/adhesive layer, whereby light loss to the back side of the lamp is minimized, thus increasing light efficiency and supplementing durability of the lamp.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A flat fluorescent lamp, comprising:

a back substrate;

a front substrate made of a transparent material and mounted on the back substrate through a sealing member disposed therebetween, to be spaced from the back substrate by a predetermined interval;

a plurality of partitions alternately disposed between the back substrate and the front substrate, to define a discharge channel of a zigzag shape therebetween, the partitions being in close contact with the front substrate;

a fluorescent material layer coated along a surface of the discharge channel defined by the partitions;

first electrodes disposed in spaced apart relation and extending substantially completely along both sides of an outer surface of the front substrate;

second electrodes disposed in spaced apart relation and extending substantially completely along both sides of an outer surface of the back substrate and facing the first electrodes; and a reflective layer formed of a combination of a white ceramic material and a glass material to cover the entire back substrate and an upper portion of the electrode of the back substrate;

wherein apertures of the electrodes are formed to have sizes decreasing gradually from an inner side of each electrode to an outer side of the fluorescent lamp.

2. The flat fluorescent lamp as defined in claim 1, wherein the partitions are integratedly formed with the back substrate.

3. The flat fluorescent lamp as defined in claim 1, wherein the partitions are made of the same transparent material as the front substrate, and are integratedly formed with the front substrate.

4. The flat fluorescent lamp as defined in claim 1, wherein the partitions comprise first partitions integratedly formed with the back substrate, and second partitions integratedly formed with the front substrate.

5. The flat fluorescent lamp as defined in claim 1, further comprising a plurality of floating electrodes disposed between the electrodes of the back substrate.

6. The flat fluorescent lamp as defined in claim 1, further comprising a plurality of floating electrodes disposed between the second electrodes of the back substrate.

7. The flat fluorescent lamp as defined in claim 1, wherein the electrodes of the back substrate have a plurality of apertures, and the apertures are formed in stripe-, circle-, polygon-, or mesh-shapes.

8. The flat fluorescent lamp as defined in claim 1, wherein the reflective layer comprises a white ceramic material including Al2O3, TiO2, and WO3, and is coated at a thickness not less than 20 μm.

9. A flat fluorescent lamp, comprising:

a back substrate;

a front substrate made of a transparent material and mounted on the back substrate through a sealing member disposed therebetween, to be spaced from the back substrate by a predetermined interval;

a plurality of partitions alternately disposed between the back substrate and the front substrate, to define a discharge channel of a zigzag share therebetween, the partitions being in close contact with the front substrate;

a fluorescent material layer coated along a surface of the discharge channel defined by the partitions;

first electrodes disposed in spaced apart relation and extending substantially completely along both sides of an outer surface of the front substrate;

second electrodes disposed in spaced apart relation and extending substantially completely along both sides of an outer surface of the back substrate and facing the first electrodes; and a reflective layer formed of a combination of a white ceramic material and a glass material to cover the entire back substrate and an upper portion of the electrode of the back substrate;

wherein the electrodes of the back substrate have a plurality of apertures, and the apertures are formed in stripe-, circle-, polygon-, or mesh-shapes; and wherein apertures of the electrodes are formed to have sizes decreasing gradually from an inner side of each electrode to an outer side of the fluorescent lamp.

* * * * *